US006931830B2

(12) United States Patent
Liao

(10) Patent No.: US 6,931,830 B2
(45) Date of Patent: Aug. 23, 2005

(54) METHOD OF FORMING A WIRE PACKAGE

(76) Inventor: Chase Liao, 11858 Preston Trails, Northridge, CA (US) 91326

( * ) Notice: Subject to any disclaimer, the term of this patent is extended or adjusted under 35 U.S.C. 154(b) by 107 days.

(21) Appl. No.: 10/326,082

(22) Filed: Dec. 23, 2002

(65) Prior Publication Data

US 2004/0118100 A1 Jun. 24, 2004

(51) Int. Cl.[7] ..... B21G 7/02; F16B 15/00
(52) U.S. Cl. ..... 59/77; 59/71; 59/75
(58) Field of Search ..... 59/71, 72, 73, 59/74, 75, 76, 77; 411/442

(56) References Cited

U.S. PATENT DOCUMENTS 2,085,780 A * 7/1937 Zeruneith ..... 59/77
2,128,443 A * 8/1938 Vogel ..... 59/77
2,137,467 A * 11/1938 Vogel ..... 59/77
2,743,445 A * 5/1956 Lerner ..... 59/77
3,234,572 A * 2/1966 Roser ..... 470/40
3,267,660 A * 8/1966 Matthews ..... 59/77
3,349,556 A 10/1967 Walter
3,751,902 A 8/1973 Kingsbury
4,066,165 A 1/1978 Ruskin
4,664,733 A * 5/1987 Masago ..... 59/74
5,414,991 A 5/1995 Kfir et al.
5,441,373 A * 8/1995 Kish et al. ..... 411/442
5,875,538 A * 3/1999 Kish et al. ..... 59/71
5,938,388 A 8/1999 Bloser et al.

* cited by examiner

*Primary Examiner*—David Jones

(57) ABSTRACT

A method for making a wire package for use as staples or brads is recited as forming a plurality of round wires, forming a plurality of flattened bonding sides on each wire to prepare even bonding surfaces on each wire and bonding each wire to an adjacent wire by adhering the surfaces of each wire. Each staple includes two or more flat surfaces to improve the bonding strength of each staple. A package of diverging staples or brads are formed using the flat bonding surfaces

11 Claims, 7 Drawing Sheets

METHOD OF FORMING A WIRE PACKAGE

BACKGROUND OF THE INVENTION

Staples and brads for manual, pneumatic and electrical tools are all made by drawing wires and forming two flat sides on each wire. The force that flattens the wire is applied to opposite sides of the wire simultaneously to form two flat surfaces and two round surfaces opposite each other.

Each round side is used to attach each wire to the next wire to form a package by adhesively bonding the round sides. The flat sides are not used as the bonding surfaces. The bonding is performed by adhesives well known in the art.

As a result of this manufactured process, the bonding strength between each wire in a package is weak. The line of contact between each round side of each wire is at the apex point on the curve created by each round side. The inherent failure causes a weak glue line and eventually causes the package of brads or staples to fall apart in the hands of the consumer during installation, Moreover, the user must then force the separated staples or wires into a feeder eventually leading to jamming or misfeed. Sometimes these jams result in destruction of the feeding unit.

A further problem inherent in producing round wires for brads or staples is width control. Width control is critical in producing wires because any discrepancies in width will produce unusable wire to form staples or brads. The tolerances are critical for size or width of a wire which fits in a fastener gun and the drawing process now required to meet these limitations is expensive and time consuming.

SUMMARY OF THE INVENTION

A method for making a wire package for use as staples or brads is recited as forming a plurality of round wires, forming a plurality of flattened sides in each wire to prepare even bonding surfaces on each wire and bonding each wire to an adjacent wire by mating the surfaces of each wire.

It is an object of the present invention to form a package of brads having flattened bonding surfaces.

It is an object of the present invention to form a package of divergent staples having flattened bonding surfaces.

Another object of the present invention is to form a plurality of wires with a controlled width.

Yet another object of the present invention is to form wires having three or more sides which are bonded at each side to produce a wire package.

Still another object of the present invention is to control the width of each wire used in making a wire package by deforming each and making a plurality of flat sides.

A method of making a novel brad or staple packaging is disclosed and presented to illustrate wire having 3 or more flat sides and preferably 6 or more. The method controls the width of each wire and to make the package.

DETAILED DESCRIPTION OF THE DRAWINGS

DETAILED DESCRIPTION OF THE PREFERRED EMBODIMENT

Figure 1:
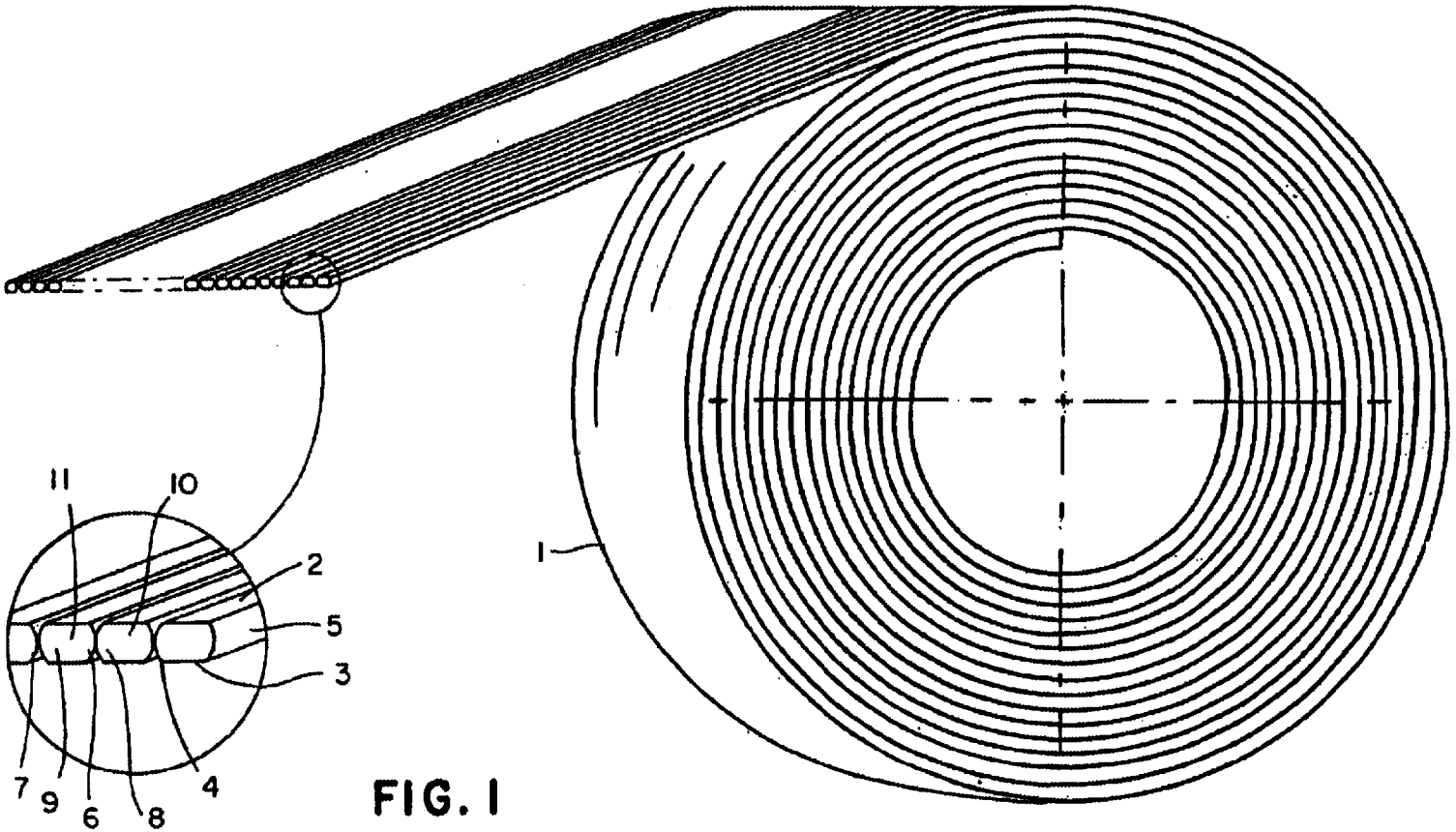
FIG. 1 is a wire package of the prior art.

A novel method of making a package of wire brads or divergent staples is disclosed and illustrated in FIGS. 2–10 and described in the present application. FIG. 1 illustrates a prior art wire package 1 drawn and formed into a brad or a staple package. A round wire is drawn and deformed to produce two flat sides 2, 3 and two round sides 4, 5. The round sides 6 and 7 are bonded to round sides 8, 9 of adjacent wires 10, 11 to form the package 1. The bonding at the center of the curve of the wire fails to provide adequate contact area.

Figure 2:
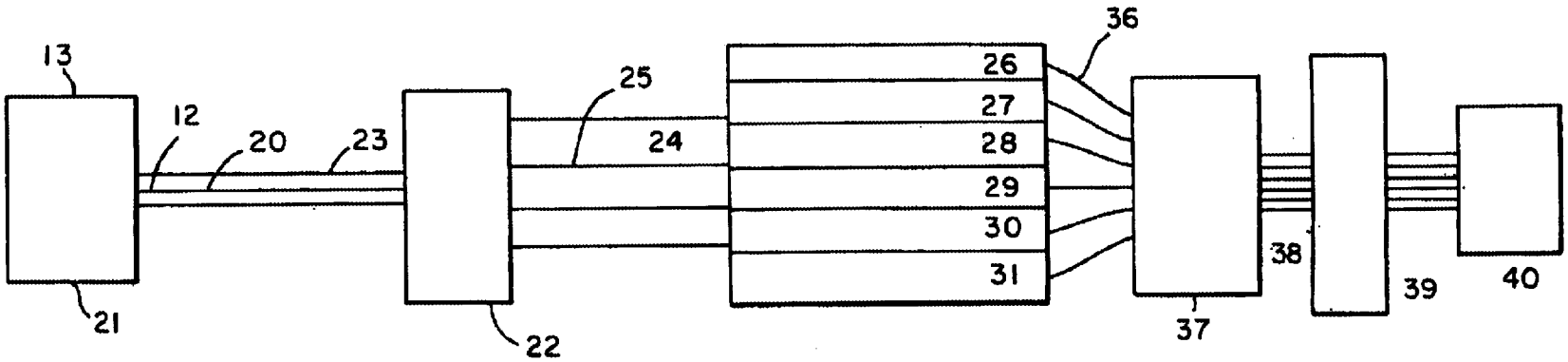
FIG. 2 is an illustrated block diagram of a process of making a wire package of the present invention.

A method of making a wire package is schematically shown in FIG. 2. A plurality of round wires 12 are drawn from a well known drawing apparatus 13 for producing round wires 14. Each wire 20 is formed of metal such as copper, steel, stainless steel, or titanium. As many as 2–200 wires at a time could be drawn from the wire drawing apparatus. In order to form the size of the wire 20 to the selected width, the techniques used in the drawing process must be precise to control the tolerances allowed in making the wire an exact width. The wires 12 as a group are drawn from the drawing apparatus 13 by conventional means where the wires 12 next enter a station 22 used to form a plurality of flat sides on each individual wire.

In order for the drawing apparatus 21 and the forming station 22 to handle anywhere from 5–200 or more wires simultaneously during the process, each station is made up of multiple modular substations. The number of substations used depends on the size of the package in production. Each substation may be added or subtracted depending on the need of the production line. Likewise, the drawing apparatus may include more substations depending on production requirements.

As shown in FIG. 2, the production of a wire package requires an in line wire handling conveyor 23, for handling a plurality of undetermined length wires 12 as they move along the line to each station. Draw station 21 produces and conveys the wires 12 to the flat side forming station 22. The flat side forming station 22 receives each wire 20 in a flat side modular substation 24 where multiple sides are formed on each wire by a deforming press 25. The deforming press 25 includes 3 or more flat side forming presses 26–31. Each flat sided forming station is modular in design and in use in that the substations and or the presses may be interchanged or added or eliminated through a quick disconnect attachment system. Since all of the stations, substations, deforming presses and flat side forming presses are identical only one will be described in order to simplify the explanation.

After the wires are bonded to form a unit, each unit is cut to a predetermined length by a severing and forming station 39 to form a wire piercing projections on one or both ends of each wire in the package. The wire package is then transferred to a deforming station 40 to make a staple package or wire package.

Figures 3, 4:
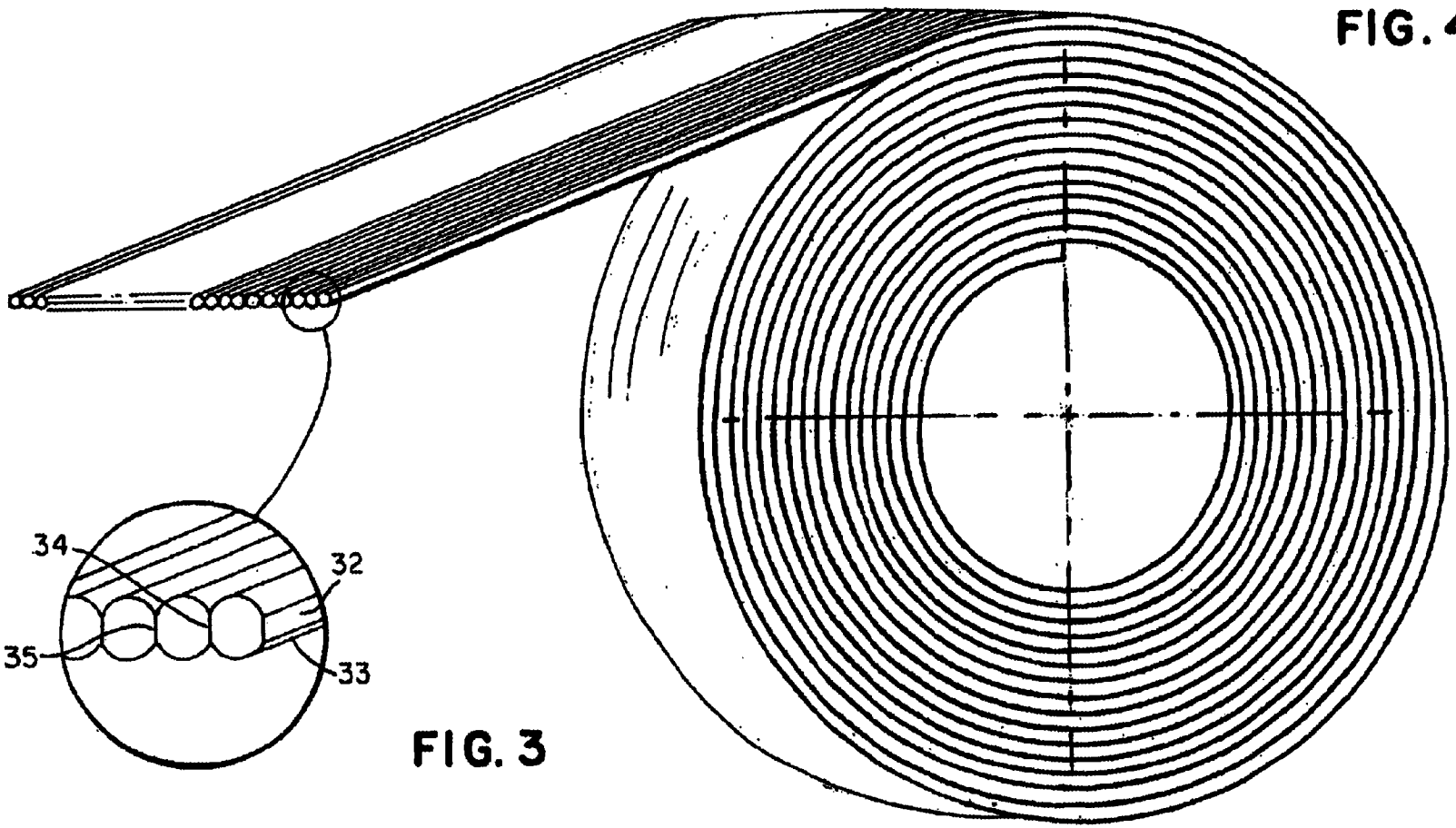
FIG. 3 is an exploded view of the circled portion of FIG. 4.
FIG. 4 is a plain view of a wire package of the present invention.

As shown in FIGS. 3 and 4, each flat side 32–35 of each wire provides a bonding surface and the process controls the width of each wire. The wires as a group 36, are then conveyed through a bonding station 37 where the wires 36 are bonded together to form a wire unit or package 38. The wires are bonded by conventional means side by side and side by side to form the package as shown in FIG. 4. The flat surfaces formed on each wire provide a large smooth bonding surface. The bonding technique prevents the unit from coming apart during the installation process.

Figure 6:
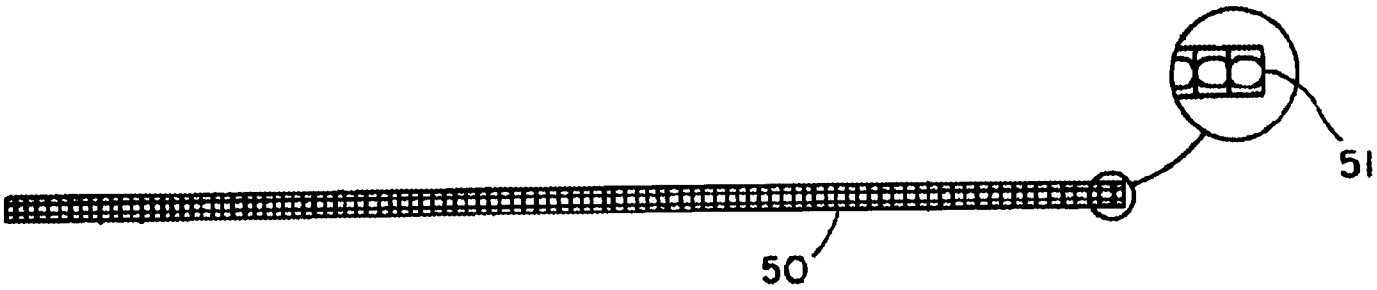
FIG. 6 is an exploded view of the circled portion of FIG. 4. of the prior art.
Figure 5:
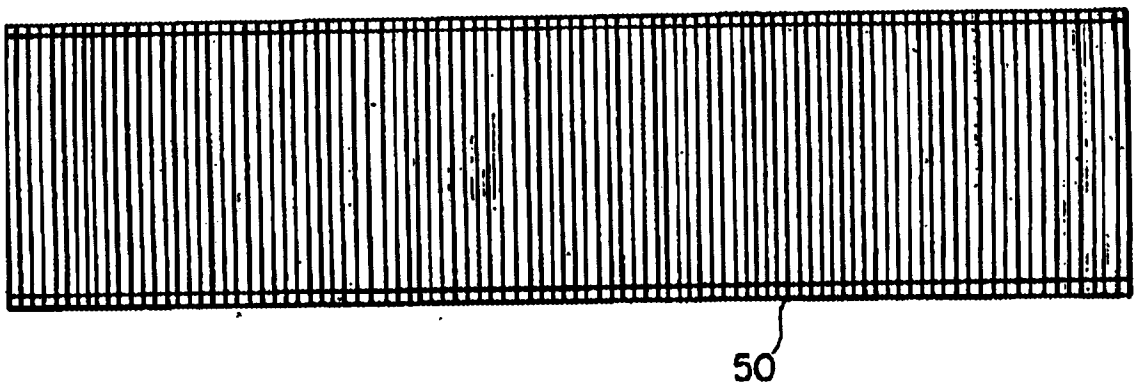
FIG. 5 is a wire package of the prior art.
Figure 9:
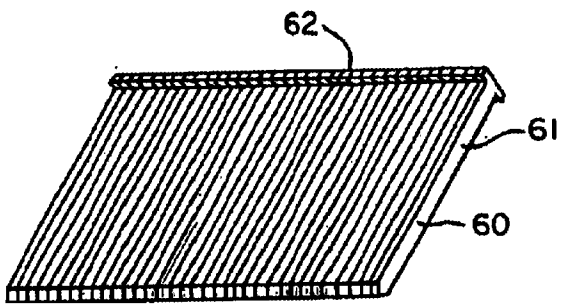
FIG. 9 is a plain view of a brad package of the present invention.
Figure 8:
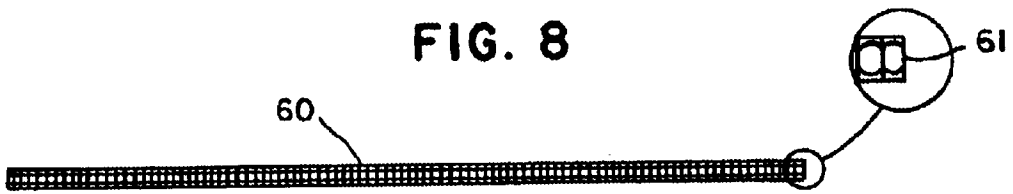
FIG. 8 is a plain view of a wire package of the present invention.
Figure 7:
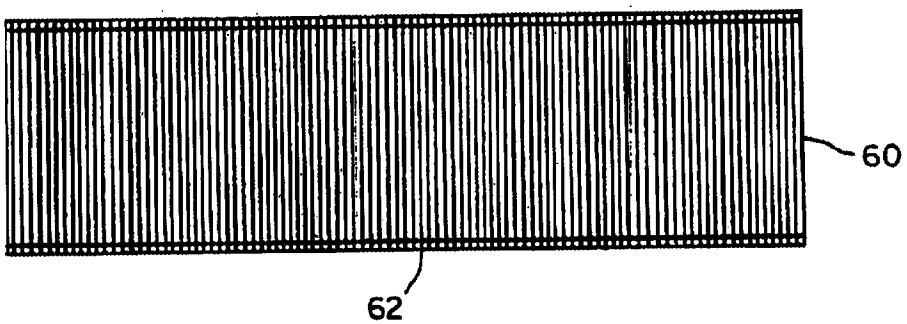
FIG. 7 is an exploded view of the circled portion of FIG. 4.

FIGS. 5 and 6 illustrates examples of prior art packages made of wires having rounded sides for bonding having a different number of sides. FIGS. 7–9 illustrate a brad wire packages of the present invention having wires with flat bonding sides and formed into packages.

The present method of forming a package of staples permits the formation of 4–12 flat bonding sides on each round wire.

In order to form a brad wire package, the wire unit is passed to a brad forming unit where heads are formed on one end of each wire. On the opposite the end, a piecing point is formed using the process previously process. The package of brads is now complete and moved to a station for packing.

In order to form a divergent staple, the wire unit is conveyed to a staple forming station where each wire unit is deformed into a u-shaped configuration. An end of the wire unit opposite of the piercing point is then cut to form a second piercing point on each wire. The bond areas created by the flat sides further prevent breaking of the bond during the deforming process.

FIGS. 5 and 6 disclose prior art brads 50 having round sides 51 which are bonded at each side. FIGS. 7, 6 and 9 disclose brads 60 having flat sides 61 which form the bonding surfaces to assemble a package 62 of brads.

Figure 10:
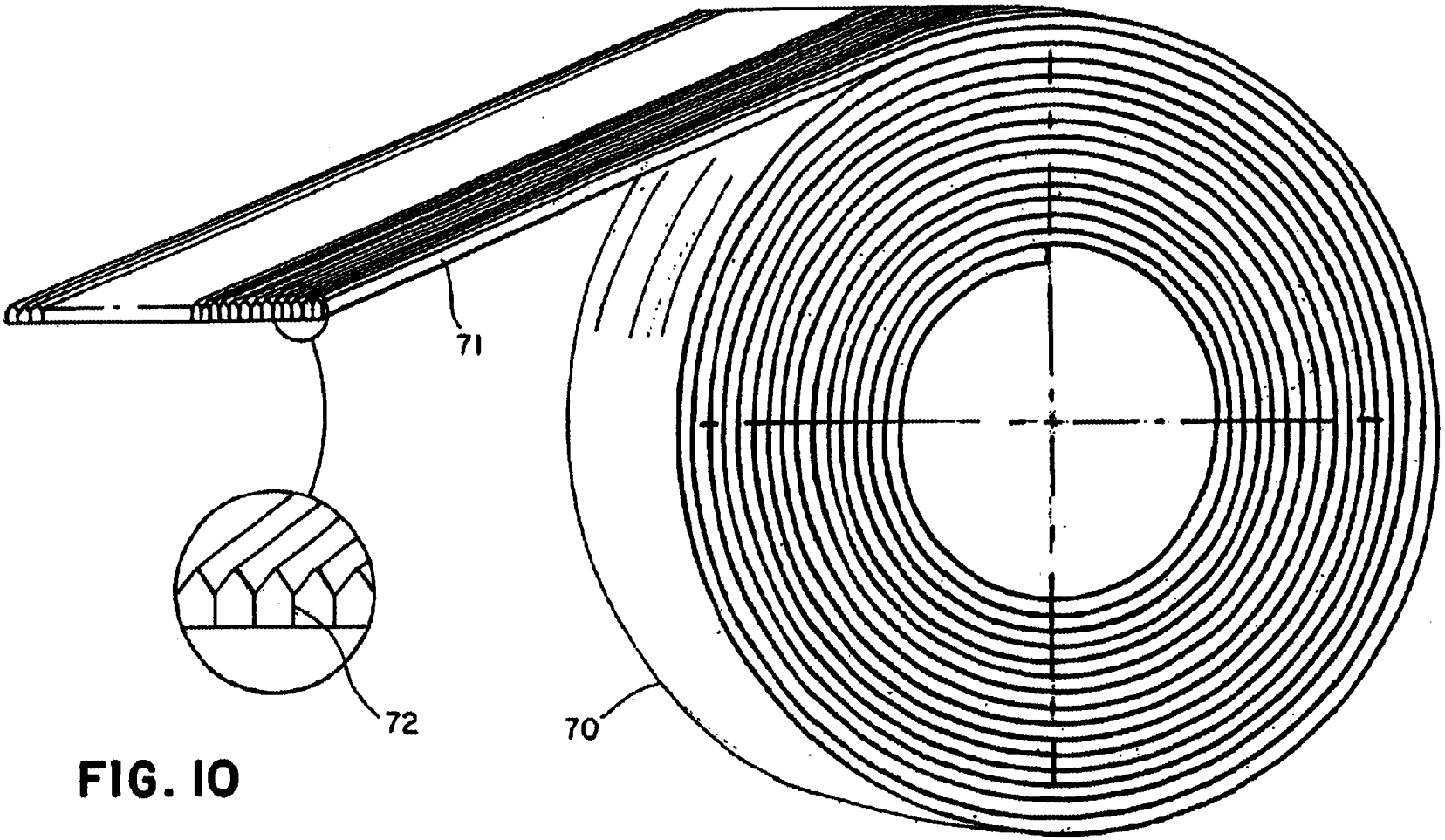
FIG. 10 is a plain view of an alternative embodiment wire package of the present invention.
Figure 11:
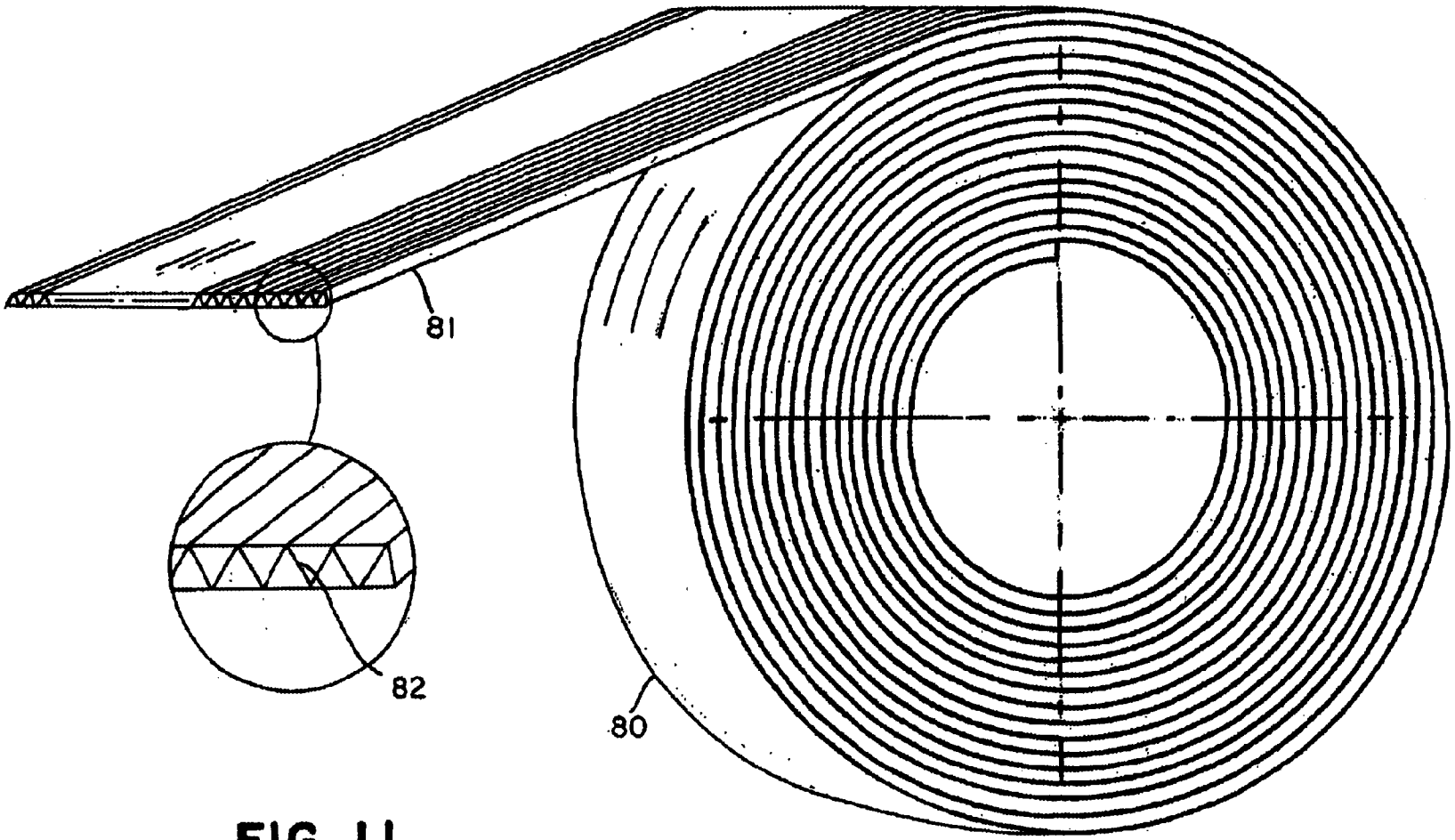
FIG. 11 is a plain view of an alternative embodiment wire package of the present invention.

FIG. 10 illustrates a wire package 70 having wires 71, each wire having at least 5 sides. Each side is flat to provide a flat bonding surface 72. FIG. 11 illustrates a wire package 80 having wires 81, each wire having a flat bonding surface 82.

What is claimed is:

1. A method of making a package of wire staples, said method comprising the following steps;

simultaneously drawing two strands of metal and forming at least two round wires, providing a force to each wire to flatten at least three or more bonding sides, and adhering a side of each wire to each other to form a package of flattened wire.

2. A method of making a package of wire staples as recited in claim 1, said method comprising the following steps;

wherein said step of producing a round wire comprises producing a round wire made of stainless steel.

3. A method of making a package of wire staples as recited in claim 1, said method comprising the following steps;

wherein said step of producing a round wire comprises producing a round wire made of copper.

4. A method of forming a package of staples, said method comprising the following steps, forming a first round wire of in determined length and deforming said wire to produce at least three flat bonding sides on said first wire, forming a second round wire of in determined length and deforming said wire to produce at least three flat bonding sides on said second wire, bonding said first wire to said second wire by applying adhesive to at least one bonding side of said first wire and adhering said adhesive bonding side of second wire severing said bonded wires to form a bonded set of wires of predetermined length, severing each end of said set of bonded wires to form a piercing point at each end of said set of bonded wires, and;

deforming said set of bonded wires into a U-shaped set of bonded wires.

5. A method of forming a package of flat sided brads, said method comprising the following steps forming a plurality of round wires having an in determined length, deforming each wire to produce at least three or more flat sides to provide flat adhering bonding surfaces, bonding a flattened side of each wire to a flattened side of an adjacent wire to form a composite strip of wires having flat sides, cutting said composite strip of bonded wires to form a composite strip of predetermined length, deforming one end of said composite strip to form a head on each wire, and;

severing an end of said composite strip of wires to form piercing point on each end of each wire to form a package of brads having flat sides.

6. A method of forming a wire package, said method comprising the following steps:

producing a round wire, producing a second round wire, flattening each wire to produce at least three flat bonding sides on each wire, bonding said first wire to said second wire by applying adhesive to one side of each wire, adhering each bonded side of said wires to each other, serving said wires to form a predetermined length of said wires, and;

deforming said wire packaged into a brad.

7. A method of making a package of wire staples as recited in claim 6, wherein said step of producing a round) wire comprises producing a round wire made of stainless steel.

8. A method of making a package of wire staples as recited in claim 6, wherein said step of producing a round wire comprises producing a round wire made of copper.

9. A method of forming a package of wire brads, said method comprising the following steps, providing at least two round wires of undetermined length, deforming each wire to form at least three or more flat sides to form smooth bonding surfaces on each wire, bonding said wires together by adhering at least one side of one wire to at least one side of said other wire, severing said wires to form a predetermined length of said bonded wires, said severing step simultaneously forming sharp ends on each end of said bonded wires and;

deforming said bonded wires into a shape to form a package of braids.

10. A method of making a package of wire staples as recited in claim 9, wherein said step of producing a round wire comprises producing a round wire made of stainless steel.

11. A method of making a package of wire staples as recited in claim 9, wherein said step of producing a round wire comprises producing a round wire is made of copper.

* * * * *